US006918630B1

(12) United States Patent
Thomas et al.

(10) Patent No.: US 6,918,630 B1
(45) Date of Patent: Jul. 19, 2005

(54) STABILITY HANDICAPPED ACCESSIBLE PICNIC TABLE

(75) Inventors: Steven M. Thomas, Cherokee, IA (US); Craig R. Thomas, Cherokee, IA (US)

(73) Assignee: R.J. Thomas Mfg. Co., Inc., Cherokee, IA (US)

( * ) Notice: Subject to any disclaimer, the term of this patent is extended or adjusted under 35 U.S.C. 154(b) by 0 days.

(21) Appl. No.: 10/684,780

(22) Filed: Oct. 14, 2003

(51) Int. Cl.[7] ..... A47B 39/00
(52) U.S. Cl. ..... 297/158.3; 297/157.1
(58) Field of Search ..... 297/158.3, 158.4, 297/158.5, 157.1; 108/50.16

(56) References Cited

U.S. PATENT DOCUMENTS 2,805,705 A * 2/1957 Bohn ..... 207/158.5
D190,744 S 6/1961 Guice
4,415,199 A * 11/1983 Wright ..... 297/158
4,522,443 A * 6/1985 Van Blankenburg ..... 297/158.3
4,917,436 A 4/1990 Thom
5,720,512 A * 2/1998 Hostetler ..... 297/158.5
D416,693 S 11/1999 Kovalchek
6,116,681 A 9/2000 Borglum
6,629,723 B1 * 10/2003 Trubee ..... 297/158.3

* cited by examiner

*Primary Examiner*—Peter M. Cuomo
*Assistant Examiner*—Stephen D'Adamo
(74) *Attorney, Agent, or Firm*—McKee, Voorhees & Sease, P.L.C.

(57) ABSTRACT

A stable, handicap accessible picnic table is provided. It generally has a flat horizontal table top having a longitudinal axis, an upper surface, a lower surface, first and second ends, and first and second sides. There are preferably a pair of leg supports for supporting the lower surface of the table top with each leg support having a ground engaging portion generally transverse to the longitudinal axis of the table top and a ground engaging portion generally parallel to the table top and extending laterally outwardly terminating in an upright seat supporting surface. The seat structure is about of the same length as the table top and mounted to the seat support surface. The ends of the table are open to allow accessibility to wheelchairs.

20 Claims, 9 Drawing Sheets

STABILITY HANDICAPPED ACCESSIBLE PICNIC TABLE

BACKGROUND OF THE INVENTION

1. Field of the Invention

This invention relates to a standardized picnic table specifically designed to accommodate handicapped users confined to a wheelchair without any sacrifice of utility to non-handicapped users. More particularly it relates to such a table which is stable to table tipping influences, both endways and sideways.

2. Background of the Invention

With the adoption of the Americans with Disabilities Act (ADA), it has become desirable to make all furniture designs user friendly and accessible to those persons unfortunate enough to be confined to a wheelchair. Government agencies such as the United States Forest Service and others have stated that in the future all site furniture shall be equally accessible by handicapped and non handicapped users alike. In particular, the Americans with Disabilities Act Accessibilities Guidelines requires specific dimensions: The seating space shall contain knee space at least 27 inches (685 mm) high, 30 inches (760 mm) wide, and 19 inches (485) deep. Toe clearance 9 inches (230 mm) minimum in height shall extend an additional 5 inches minimum from the knee clearance.

In the past, there have been attempts at designing wheelchair accessible picnic tables. For example, U.S. Pat. No. 6,116,681, Borglum of Sep. 12, 2000 lays claim to a modification of a popular and widely standardized picnic table frame design that originates from a National Park Service design dating from at least as early as the 1950's which incorporates a J-shaped leg made from bent round pipe. However, in some embodiments of this table there is a sacrifice in the seating along the sides of the table in order to accommodate wheelchairs, and in other embodiments the wheelchair is accommodated at the end, by an extension of the top considerably beyond the frame support and seat end whereby there is a loss of utility to non-handicapped users. In addition the table sacrifices some stability, because of this extension from the supporting frame of the table, even in spite of the fact that some versions of it use so called anti-tipping feet. The table still remains unstable and capable of tipping sideways and the anti-tipping feet cause problems. This is true because of the loss of support on the outside of the bend of the two dimensional "J leg".

Other examples of handicap accessible picnic tables include for example U.S. Pat. No. 4,917,436 of Apr. 17, 1990. It uses a generally circular as opposed to elongated picnic table. It, however, sacrifices some seating as well in order to accommodate wheelchairs.

It can be seen, therefore, that there is a continuing need, particularly in view of the federal government's emphasis in its contracts for outdoor camp site furniture, for improved picnic tables that are not only handicapped accessible without any sacrifice in accessibility or ease of use for non-handicapped users but also have improved stability for safer use without risk of injury.

It is accordingly a primary object of the present invention to develop a picnic table frame that, by its inherent design, does not make it an impediment to handicapped persons, without making a design that is specifically for handicapped individuals. In other words to make a standard product that will work equally well for the handicapped or non handicapped without sacrifice of convenience to either user.

Another objective that suppliers are constrained by is the fact that due to government procurement procedures and the wide use of picnic tables by agencies and municipalities, the improvement over conventional tables must be available without significant increase in costs and be produceable inexpensively by conventional industrial mass production methods.

Another objective of the present invention is to provide an improved stability handicapped accessible picnic table which has substantially eliminated the risk of both endways and sideways tipping, regardless of whether the weight of all users concentrated on one side of the table or at the end of the table seats and/or top.

The method of accomplishing these and other objectives of the present invention will become apparent from the detailed description which follows.

SUMMARY OF THE INVENTION

A stable, handicap accessible picnic table is provided. It generally has a flat horizontal table top having a longitudinal axis, an upper surface, a lower surface, first and second ends, and first and second sides. There are preferably a pair of leg supports for supporting the lower surface of the table top with each leg support having a ground engaging portion generally transverse to the longitudinal axis of the table top and a ground engaging portion generally parallel to the table top and extending laterally outwardly terminating in an upright seat supporting surface. The seat structure is about of the same length as the table top and mounted to the seat support surface. The ends of the table are open to allow accessibility to wheelchairs, exceeding the Americans with Disabilities Act Accessibility Guidelines (ADAAG) 16.5.4 dimensional guidelines for wheelchair accessibility.

DETAILED DESCRIPTION OF THE PREFERRED EMBODIMENT

The primary objective is for a picnic table whose legs are designed to allow wheelchair access to the table (as per ADA dimensional specification) and yet still allow the table to maintain the nontip, nontrip, walk-through design feature without diminishing or detracting from non handicapped use by reducing the seating capacity when a wheelchair is not present. Since wheelchair use is only required by a small percentage of the population, an improvement to the design of commercial picnic tables that provides for public use and that still allows for entire usage of the table without inconvenience by non wheelchair users is highly desirable, and most economical for government agencies and municipalities. Furthermore, this design is of enhanced stability for all users whether handicapped or not. In particular, the new design by its improvements resist the likelihood of tipping end ways in the event one would sit on the table, because the attachment point to the seat is extended toward the end of the table. This tendency to tip is a problem of the extended end table design when the table does not have enough mass to counterbalance weight when material such as aluminum planks are used for the top and seats. It is further exacerbated in U.S. Pat. No. 6,116,181 by removal of the counter balancing portion of the seat as acknowledged by their use of a welded extension foot #160 which is used to reduce tipping. The present design is inherently more stable because "J legs" are avoided.

Figure 1:
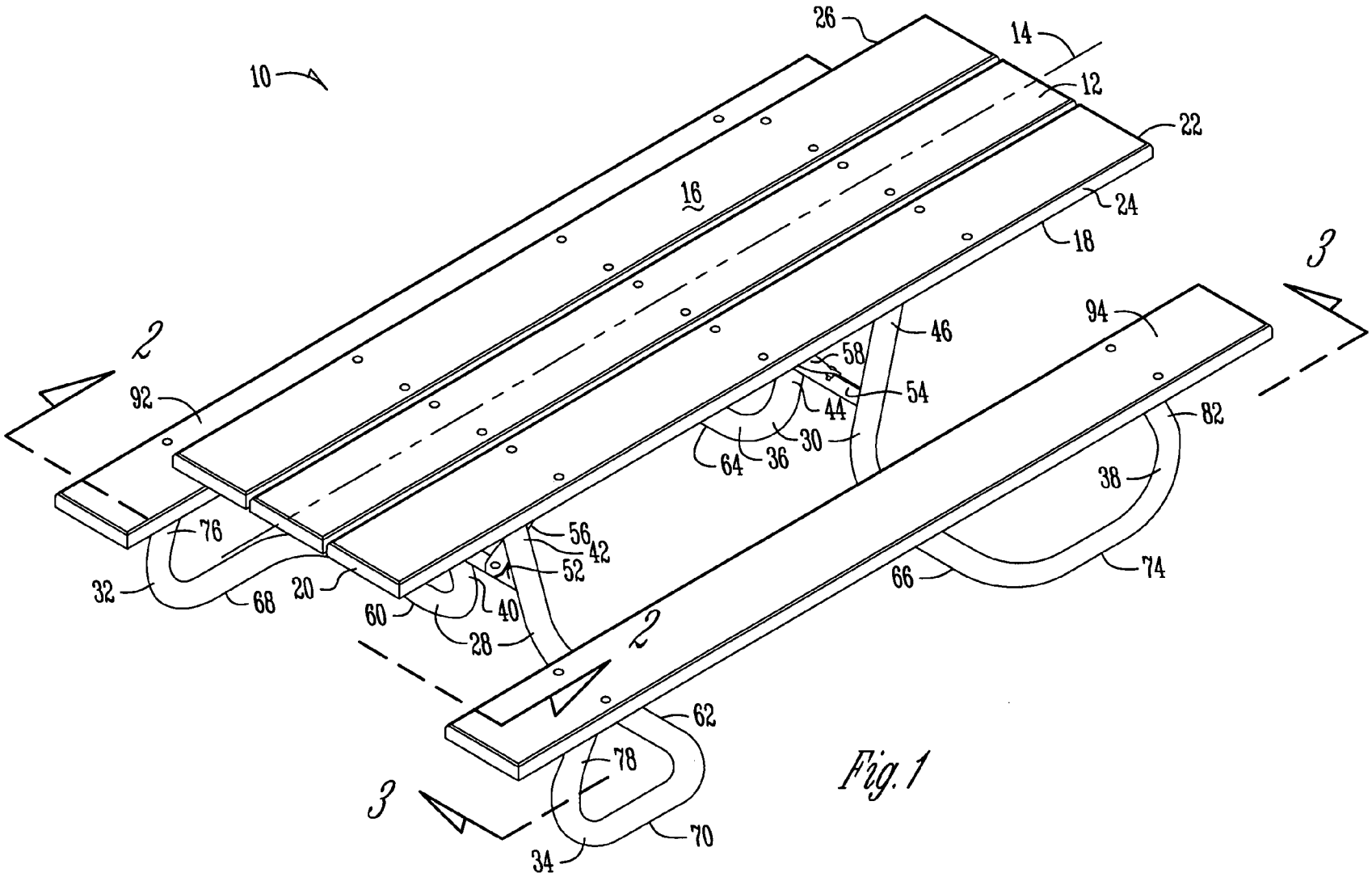
FIG. 1 is a perspective view of a preferred embodiment of the invention.
Figure 2:
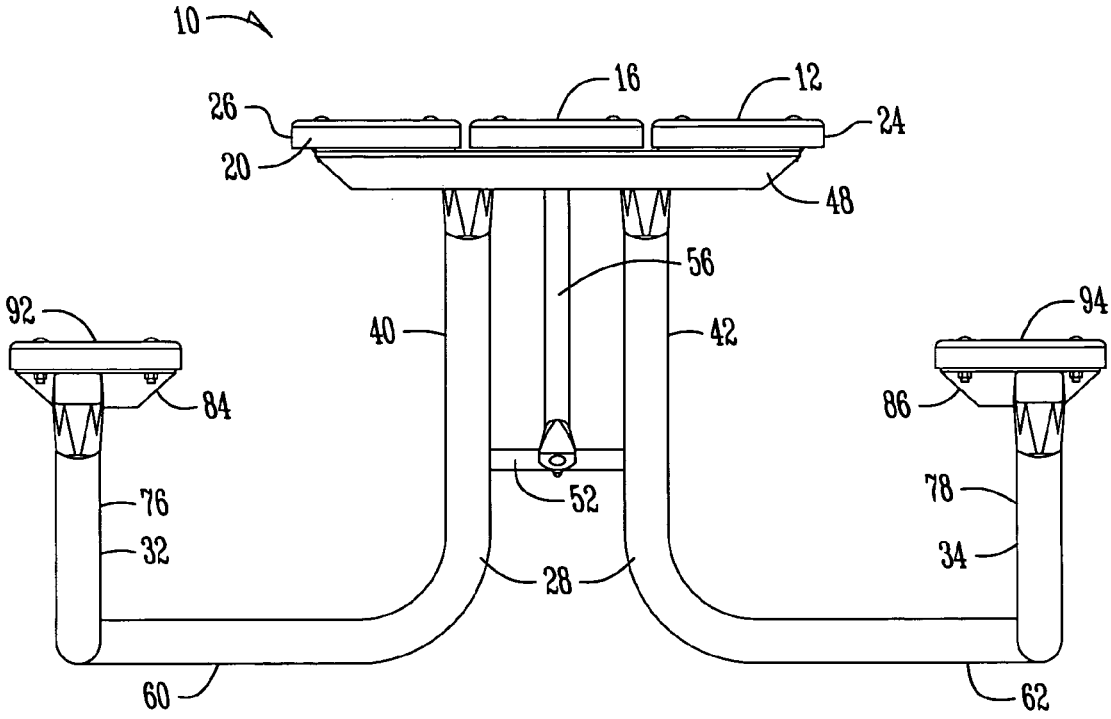
FIG. 2 is an end view of the table along line 2—2 of FIG. 1.
Figure 3:
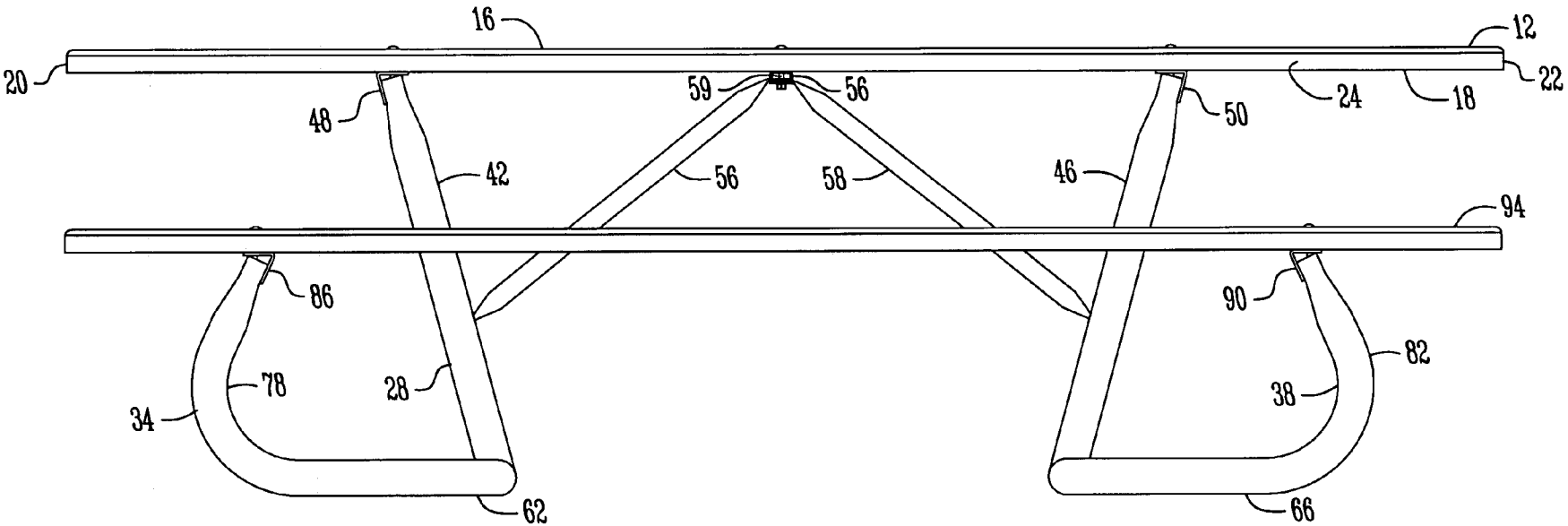
FIG. 3 is a side view of the table along line 3—3 of FIG. 1.
Figure 4:
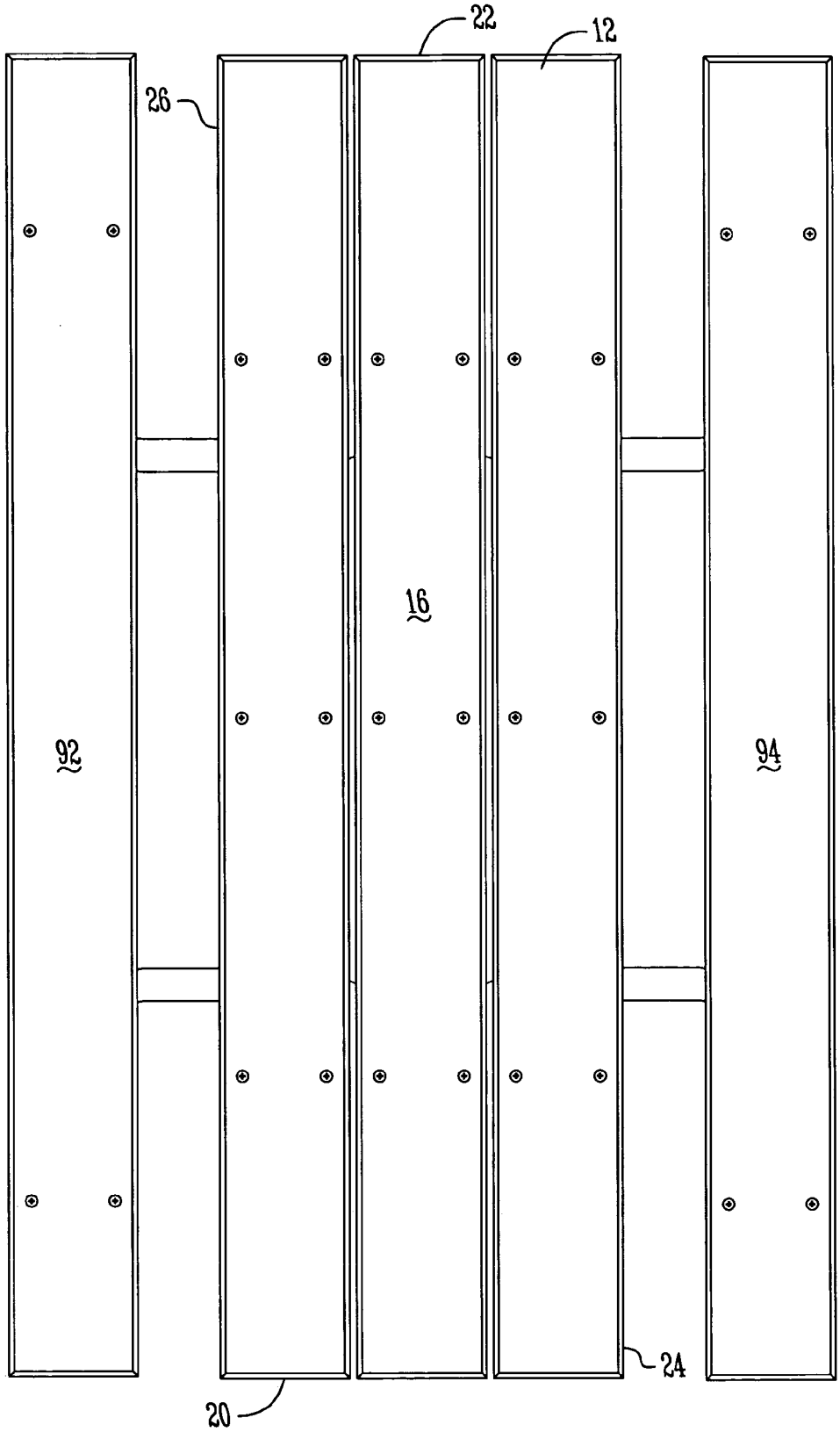
FIG. 4 is a plan view of the table of FIG. 1.

In particular, FIG. 1 shows a perspective view of a preferred embodiment of the picnic table 10 of the present invention. The table is comprised of a generally flat elongated horizontal table top 12 having a longitudinal axis 14, an upper surface 16, a lower surface 18, first and second ends 20, 22, and first and second sides 24, 26. Preferably a first and second pair of leg support 28, 30 support the lower surface 18 of table top 12. The first pair of leg supports comprise mirror images of each other as do the second pair of leg supports 30. Each leg support 32, 34, 36, and 38 have generally an upright post portion 40, 42, 44, and 46 attached to table supports 48, 50. Braces 52, 54 join legs 32, 34 and 36, 38 respectively. Similarly, brace 56 joins brace 52 connected to the under surface 18 of table top 20 and brace 58 connects brace 54 and the under surface of table top 18 at bolt 59 where they both connect to a channel 61 that crosses the center of the bottom surface 18 of table top 20.

As heretofore expressed, "J legs" of the type shown in Borglum U.S. Pat. No. 6,116,681 are unsatisfactory in that they induce a natural rolling tendency to the table, i.e., tipping over from side to side. Even end ways tipping, which may be prevented by anti-tipping feet 160 of Borglum, can be eliminated in the present invention without having anti-tipping feet 160 which represent a disadvantage. Such anti-tipping feet represent a disadvantage because they may be contacted with the front wheels of a wheelchair creating interference problems, users may trip over them, and they as well represent extra labor and expense in attaching them.

In the present invention, the function of anti-tipping feet designated 160 of Borglum U.S. Pat. No. 6,116,681 is eliminated by having legs 32, 34, 36, and 38 of the configuration hereinafter described. In particular, each leg 32, 34, 36, and 38 has a ground engaging portion 60, 62, 64 and 66 generally transverse to the longitudinal axis 14 of the table top 12, and a joined ground engaging portion, 68, 70, 72, and 74, generally parallel to the table top terminating in an upright seating support post 76, 78, 80 and 82 that is joined to a seat support plate 84, 86, 88, and 90. A seat plank 92 is joined to plates 84 and 88 and a seat plank 94 is joined to seat plates 86 and 90.

It can be seen that at the respective ends 20 and 22 of table top 12 an open area is defined between legs 32 and 34 and 36 and 38 of sufficient width to access a wheelchair to meet Americans with Disabilities Act Accessibilities Guidelines (ADAAG) 16.5.4 dimensional guidelines for wheelchair accessibility. Moreover, there is no generally circular structure as in a "J leg" to define a radius and corresponding moment arm to allow tilting or rocking in either a lateral direction or an end-wise direction. Thus the tipping disadvantages of a "J leg" are avoided.

When the "J leg" design is used with all individuals sitting on the same table side, it is required that enough of the weight of the table must counterbalance the individuals seated to prevent the table from tipping. This is because the tangent of the bend radius at the bottom of the table is under the seat of the table where the weight of the individuals is concentrated. To overcome this tipping effect the bend radius is minimized and the attachment point is at the outside of the seat in the frame of the present invention. A minimum bend radius of 2½ times the diameter is desirable in mass production where the large diameter and heavy weight of pipe is required for commercial public use to enhance product longevity and combat vandalism. It is not desirable to have a sharp corner as by cutting and welding for appearance and the economy of mass production. Furthermore, good design practice developed over years of practical experience avoids any extension of the frame member, beyond the vertical plane of the back of the seat plank, to become a bumping or tripping point for persons using the table. Thus, the tables of FIGS. 1–5 are preferred. By placing the bend as is done on the new wheelchair accessible design, the base of the table is widened. Comparing the end view of FIG. 3 with the "J leg" design end view of U.S. Pat. No. 6,116,681, the improved design shows the width of the base of the present table is greater increasing stability of the frame design.

As described, the anti-tipping nature of the frame design is further limited because the fulcrum of the bending point moves toward the source of the tipping force thereby reducing the moment arm of tipping movement. Therefore, the frame as defined has a tendency to limit the extent of tipping and self regulate the instability. This is a useful feature in the use of a shortened table with lighter material such as aluminum where less of the mass of the table is available to counter act the tipping of the table.

Figure 5:
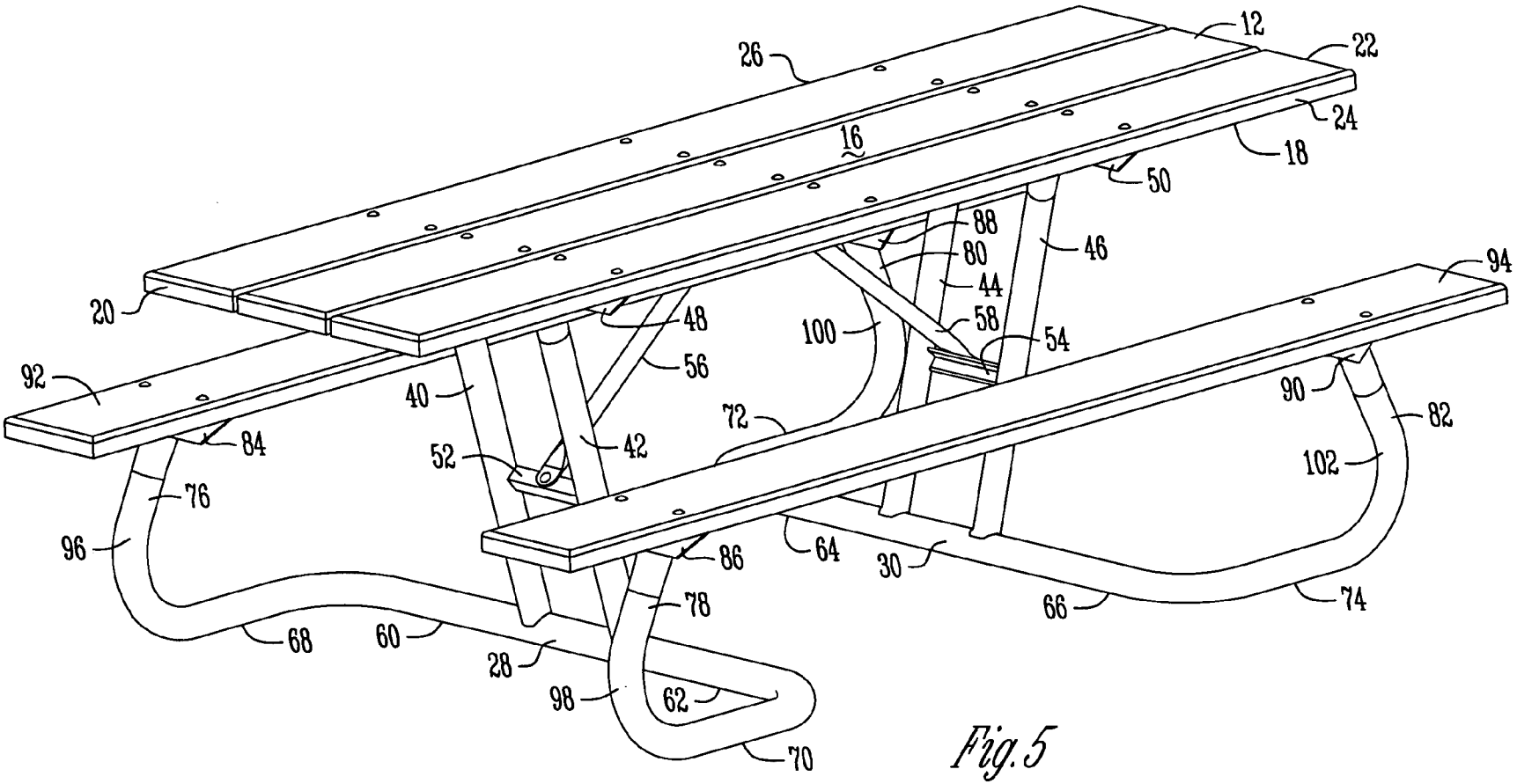
FIG. 5 is a perspective view of another embodiment of the invention.
Figure 6:
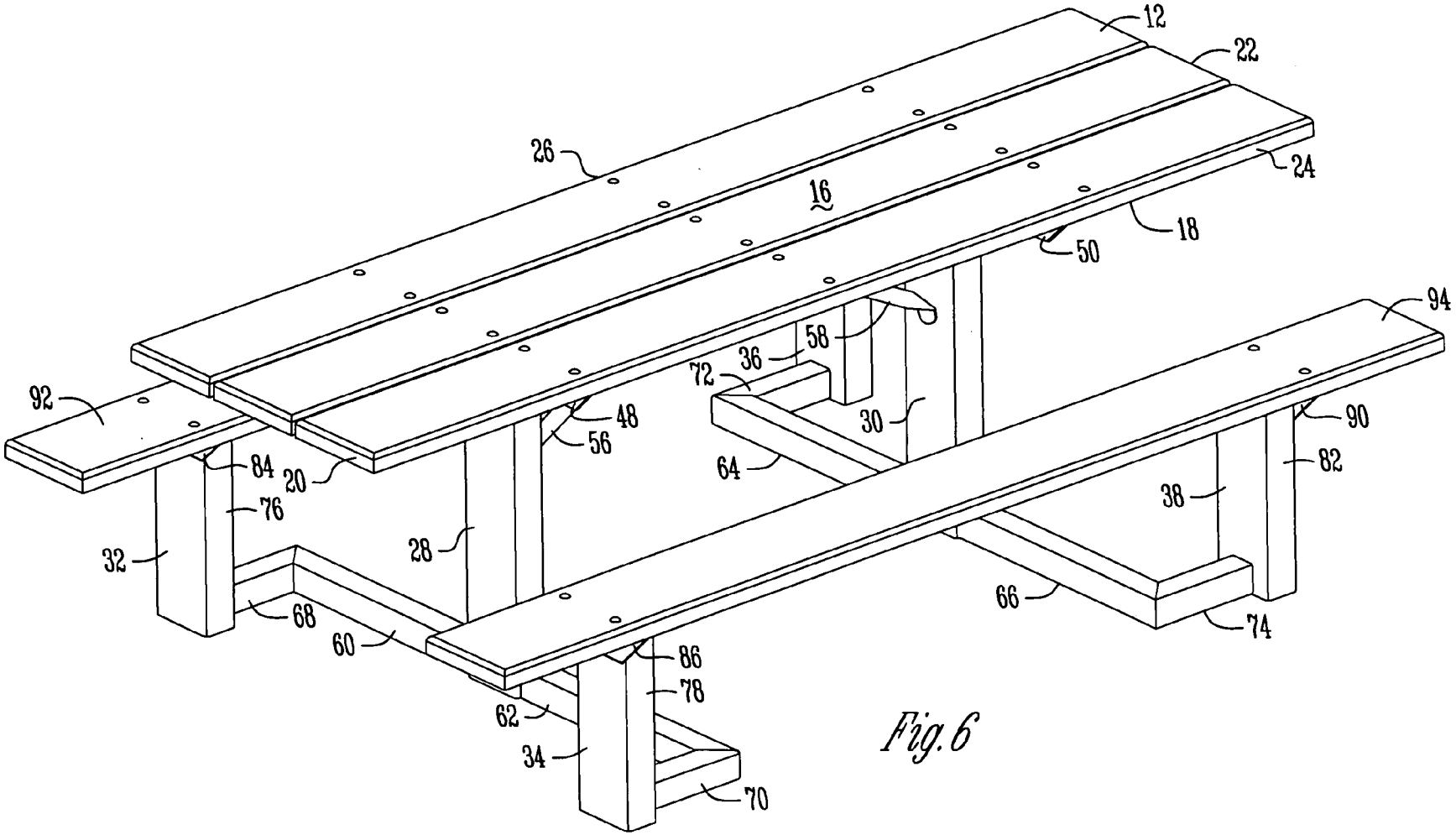
FIG. 6 is a perspective view of yet another embodiment of the invention.
Figure 7:
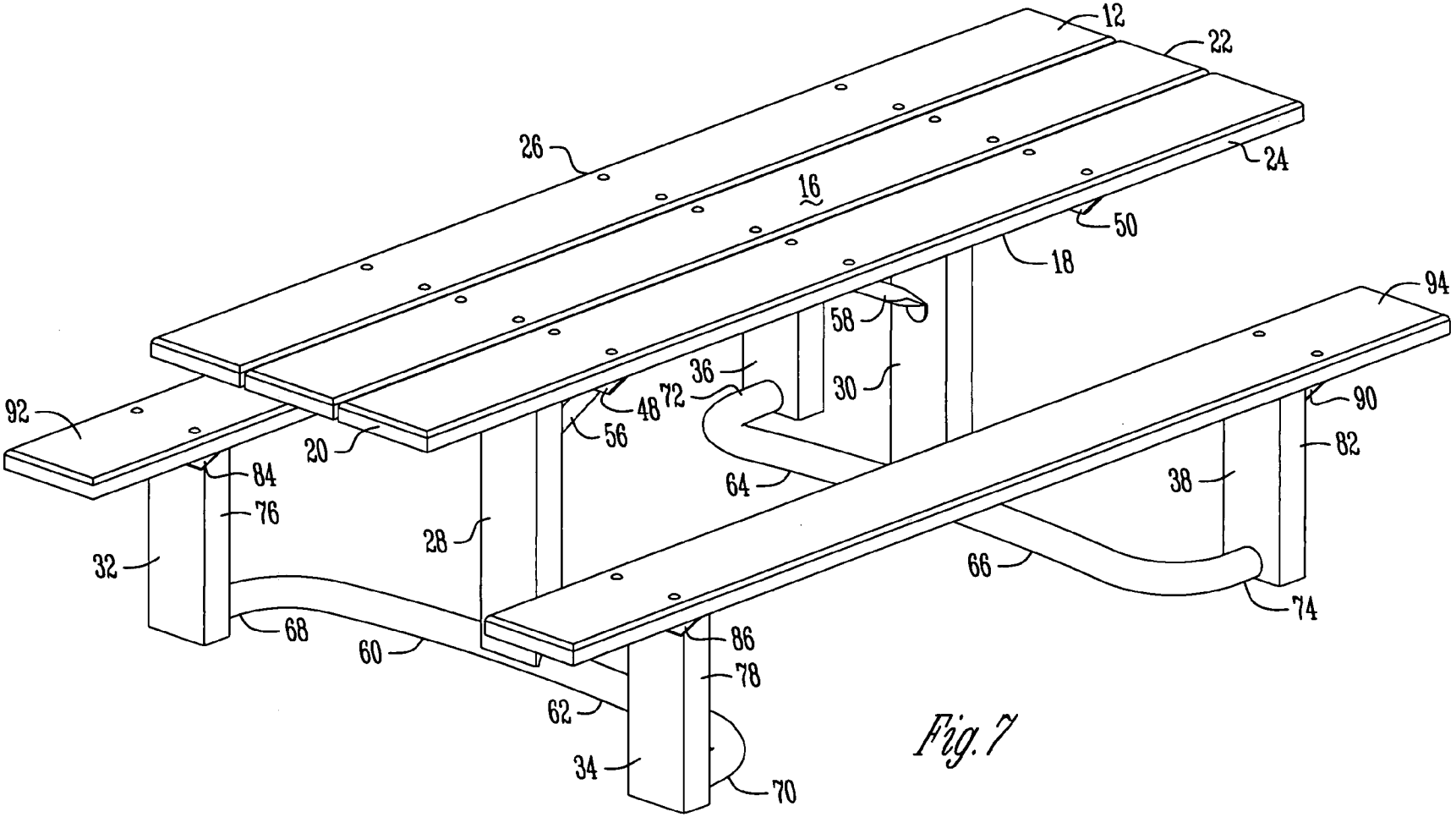
FIG. 7 is a perspective view of still another embodiment of the invention.
Figure 8:
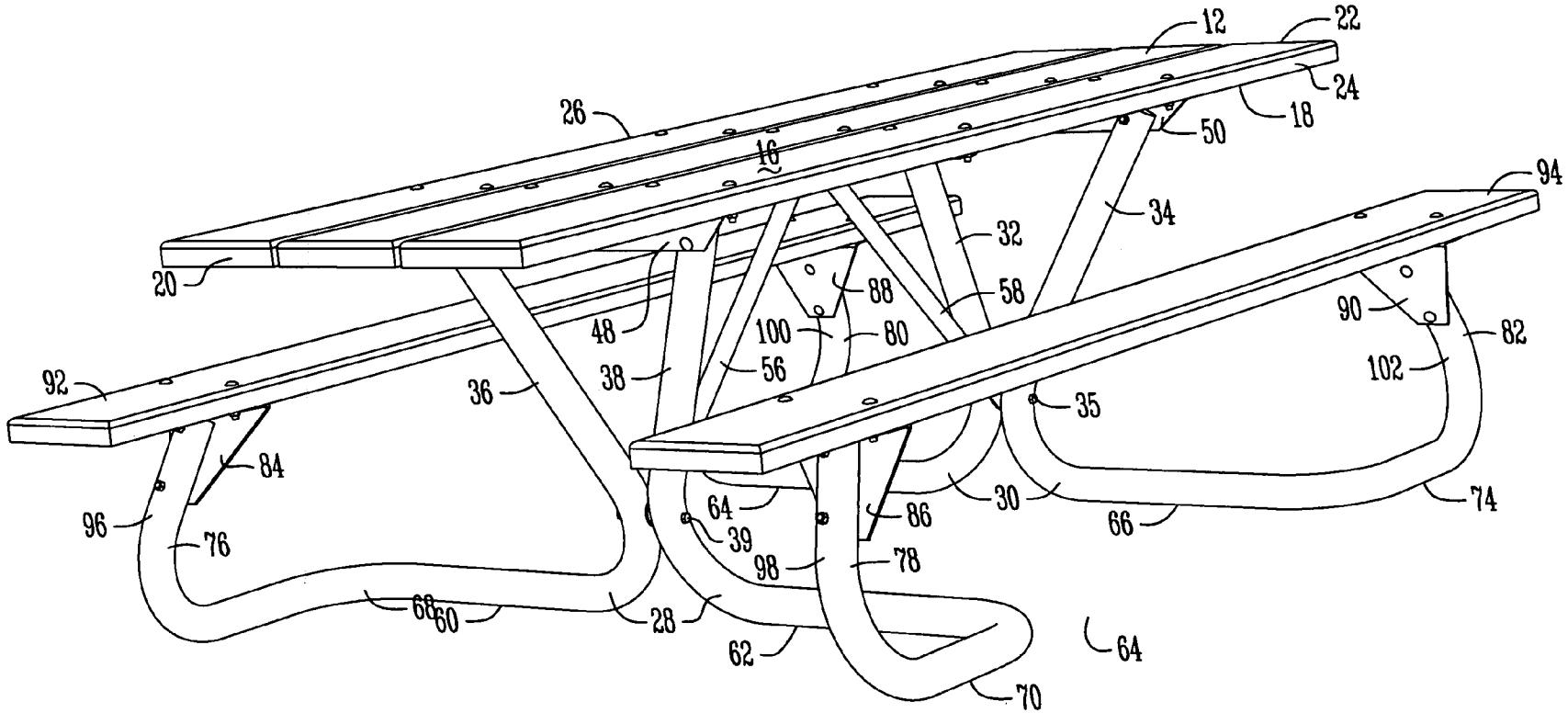
FIG. 8 is a perspective view of a further embodiment of the invention.
Figure 9:
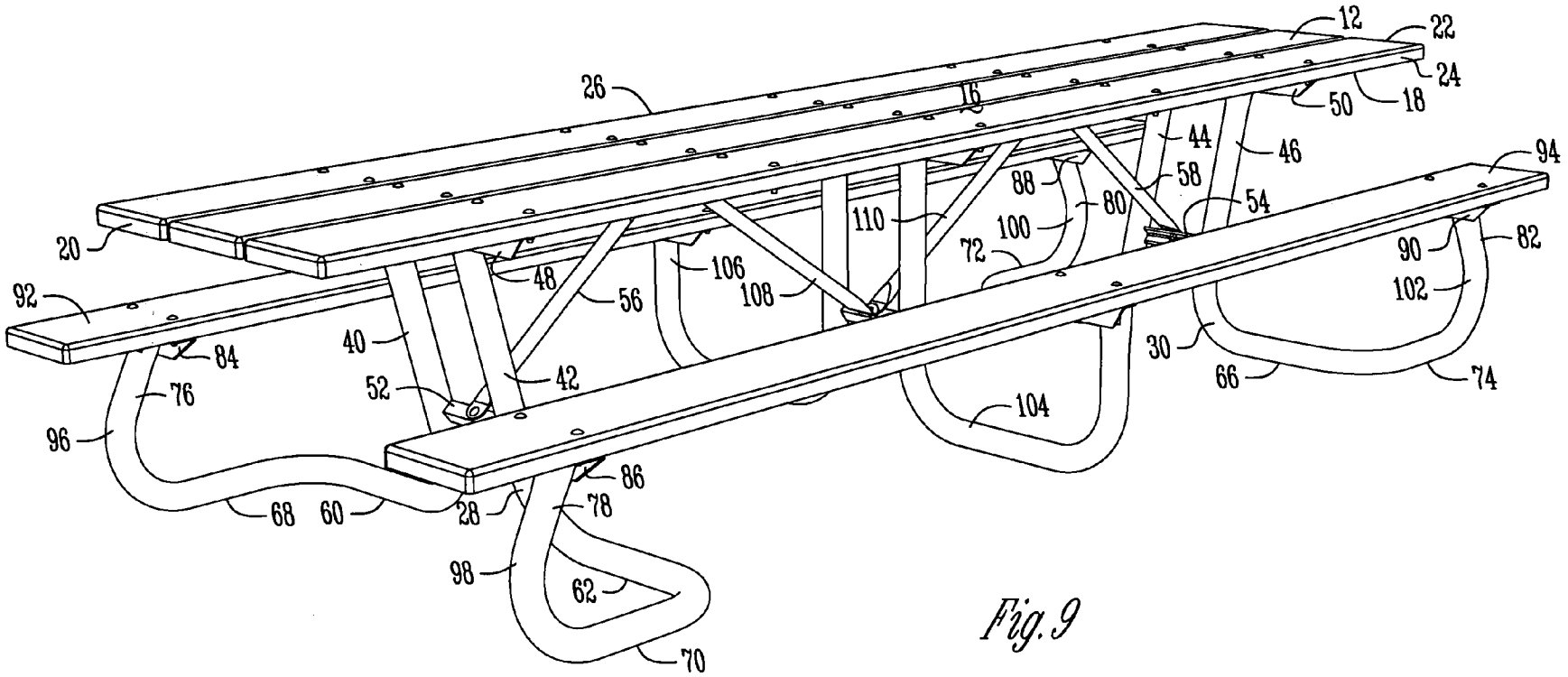
FIG. 9 is a perspective view of an extended length version of the picnic table of the invention.

FIG. 5 describes another preferred embodiment of a similar construction to that shown in FIGS. 1–4 except that the pair of leg supports 32, 34 and 36, 38 are replaced by a single unitary structure with two leg support posts. However, the principal of the operation is the same. Similarly, in FIGS. 6 and 7, the bent rounded corner of steel tubing or pipe is replaced with square bent right angle configuration but the principals of operation are the same. FIG. 7 shows a mixed hybrid using some rounded surface stock and some right angle 90° bent dimensional stock. FIG. 8 shows a table 10 wherein the legs 32, 34 and 36, 38 are bolted together at 35 and 39 for increased strength and stability. FIG. 9 shows an extended length version of the picnic table using a middle position leg configuration designated generally as 104 and 106 joined to the table by braces, 108 and 110.

Certain dimensional configurations are worthy of mention. The table may be conventional size, generally from small tables of 6–8 feet in length to more conventional sized tables of 8–12 feet in length with the seats of parallel configuration. The tubing of the frame work is preferably steel tubing or pipe of a circular in stock conventionally bent by techniques known to those of ordinary skill in the art, or it can be where a rectangular cross sectioned tubing is illustrated in the drawings of FIGS. 5, 6 and 7 where the same numerals are applied to like framework. The wooded dimensional lumber planks, generally preferred because they are the most economic (or least expensive), may be replaced with recycled plastic planks, extruded aluminum stadium planking or vinyl coated perforated steel or vinyl coated expanded metal (steel) for the benches or the table top.

Important to the accessibility to handicapped users in combination to importance with table stability and user full capacity seating, is that the seat 94 and the table top 16 extend into the same vertical plane at their ends. In other words, accommodation to Americans with Disabilities Act Accessibility Guidelines is accomplished without any sacrifice in user capacity.

It should be apparent that various modes of carrying out the invention are contemplated, as are various modifications to frame work but all falling within the scope of the invention if the critical features of the invention outlined above are employed. Applicant intends to claim the widest scope of doctrine of equivalents allowed by current state of the law.

What is claimed is:

1. A stable, handicapped accessible picnic table, comprising:

a generally flat horizontal table top having a longitudinal axis, an upper surface, a lower surface, first and second ends, and first and second sides;

at least one seat structure located on a side of the table top, the seat structure generally parallel with the longitudinal axis of the table top, spaced away from the table top, and lower than the table top;

first and second leg supports supporting the table top and at least one of seat structures;

each leg support comprising:

an upright post having an upper end attached to the lower surface of the table top and extending downward to a lower end adjacent a ground surface;

at least one first ground engaging member extending from the upright post generally traverse to the longitudinal axis of the table top, the first ground engaging member having an inner end attached to the lower end of the upright post and an outer end beneath the seat structure;

a second ground engaging member attached to the first ground engaging member and generally parallel to the longitudinal axis of the table top, the second ground engaging member having an interior end attached to the first ground engaging member outer end and an exterior end beneath the seat structure;

a seating support post attached to the second ground engaging member and extending upward, the upright seating support having a lower end attached to the second ground engaging member exterior end and an upper end attached to the seat structure.

2. The picnic table of claim 1 wherein the first and second leg supports are bent to avoid sharp right angle corners.

3. The picnic table of claim 1 which has a first and second pair of similarly configured leg supports.

4. The picnic table of claim 1 wherein the top and seats are dimensional wood planks.

5. The picnic table of claim 1 wherein the top and seats are dimensional plastic planks.

6. The picnic table of claim 1 wherein the top and seats are extruded aluminum stadium planks.

7. The picnic table of claim 1 wherein the top and seats are constructed of vinyl coated fabricated expended metal.

8. The picnic table of claim 1 wherein the table top and seats are constructed of perforated steel.

9. The picnic table of claim 1 wherein the ends of the table top and the ends of the seat structure dwell in the same vertical plane.

10. The picnic table of claim 1 wherein the seat structure is of about the same length as the table top's longitudinal axis.

11. The picnic table of claim 1 wherein at least one of the upright post, first ground engaging post, second ground engaging post, or seating support post is a square post.

12. The picnic table of claim 1 wherein the upright post includes a first table support member and a second table supporting member, each table supporting member having an upper end attached near a side of the table top and extending diagonally downward to a lower end in approximate vertical alignment with the longitudinal axis of the table top.

13. The picnic table of claim 1 wherein the leg supports are of steel frame material.

14. The picnic table of claim 13 wherein the leg supports are steel tubing or pipe of circular cross section.

15. The picnic table of claim 1 wherein each of the first and second table top ends are open under its lower surface to allow wheelchair access.

16. The picnic table of claim 1 wherein the upright post angles inward from the lower surface of the table top to promote wheelchair access.

17. The picnic table of claim 1 wherein the leg support is of a single tube with bends between the upright post and the first ground engaging member, the first ground engaging member and the second ground engaging member, and the second ground engaging member and the seat post.

18. The picnic table of claim 17 wherein each bend has a minimum radius of 2.5 times the tube diameter.

19. The picnic table of claim 1 wherein a pair of first ground engaging members are attached to the upright post, a single tube with bends making the pair of first ground engaging member and the second ground engaging member.

20. The picnic table of claim 19 wherein the single tube has further bends that make the seating support post.

* * * * *